US007278936B2

(12) United States Patent
Tucker, Jr.

(10) Patent No.: US 7,278,936 B2
(45) Date of Patent: Oct. 9, 2007

(54) SOFT MESH LACROSSE HEAD POCKET HAVING SELECTIVELY COATED STRINGS

(75) Inventor: Richard B. C. Tucker, Jr., Baltimore, MD (US)

(73) Assignee: STX, LLC, Baltimore, MD (US)

( * ) Notice: Subject to any disclaimer, the term of this patent is extended or adjusted under 35 U.S.C. 154(b) by 172 days.

(21) Appl. No.: 10/926,297

(22) Filed: Aug. 26, 2004

(65) Prior Publication Data

US 2006/0046876 A1 Mar. 2, 2006

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512–513; D21/724
See application file for complete search history.

(56) References Cited

U.S. PATENT DOCUMENTS 3,507,495 A 4/1970 Tucker et al.
4,034,984 A 7/1977 Crawford et al.
4,049,273 A * 9/1977 Pool ..... 473/513
4,238,262 A * 12/1980 Fishel ..... 156/166
4,249,731 A * 2/1981 Amster ..... 473/543
4,938,480 A 7/1990 Lods
5,269,532 A * 12/1993 Tucker et al. ..... 473/513
5,566,947 A 10/1996 Tucker et al.
6,506,132 B1 * 1/2003 Brine et al. ..... 473/513
6,520,875 B1 2/2003 Crawford
2001/0044347 A1 11/2001 Crawford
2002/0160865 A1 * 10/2002 Brine et al. ..... 473/513
2002/0173389 A1 11/2002 Morrow

OTHER PUBLICATIONS

Plasti-Dip Technical Data Sheet #5, Jan. 22, 2002, 2 pages.*

* cited by examiner

*Primary Examiner*—Eugene Kim
*Assistant Examiner*—M. Chambers
(74) *Attorney, Agent, or Firm*—Paul, Hastings, Janofsky & Walker LLP

(57) ABSTRACT

A lacrosse head having a soft mesh pocket with an area of its strings coated with stiffening material. The coated area defines, for example, a ball release area, a ball pocket, and/or a throwing channel. One embodiment provides a lacrosse head pocket that includes a continuous piece of mesh, and a stiffening material coating a first area of the mesh, with a second area of the mesh being uncoated. The first area defines, for example, a ball release area, a ball pocket, and/or a throwing channel.

39 Claims, 10 Drawing Sheets

900

200

300

400

500

600

700

800

900

SOFT MESH LACROSSE HEAD POCKET HAVING SELECTIVELY COATED STRINGS

BACKGROUND

1. Field of the Invention

The present invention relates generally to lacrosse sticks, and more particularly, to a lacrosse head having a soft mesh pocket with selectively coated strings.

2. Background of the Invention

FIG. 1A illustrates a conventional lacrosse stick 100 having a handle 102 shown in dotted lines and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 114. A screw or other fastener placed through opening 107 secures handle 102 to head 104. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Conventional lacrosse stick heads, such as the one shown in FIG. 1A, generally have one of two well-known pocket configurations. The first configuration, generally referred to as the "traditional pocket," typically includes thongs made of leather or synthetic material strung from upper thong holes in transverse wall 112 to lower thong holes in stop member 114. To complete the pocket web, the thongs have nylon strings threaded around the thongs and string laced through string holes in sidewalls 108 and 110, forming any number of diamonds (crosslacing).

The second pocket configuration, generally referred to as the "mesh pocket," typically uses a mesh knitted as a continuous piece of material. This continuous piece of material attaches to the lacrosse head as a single unit. The mesh is typically attached to the lacrosse head using transverse lacing, which reinforces the web of the mesh that is adjacent to the lacrosse head.

FIG. 1B illustrates an example of a mesh pocket 30. Rather than the longitudinal thongs and open weave lacing of the traditional pocket, the mesh pocket uses a mesh knitted as a continuous, typically uniform design of woven material having a plurality of openings or "mesh diamonds" provided therein. The mesh diamonds are "uniform" because the diamonds are all of the same size. The mesh is peripherally coupled to the head of the lacrosse stick by a single stringing cord, by multiple stringing cords, or by other binding materials (e.g., hook and loop fasteners). The exemplary mesh pocket 30 of FIG. 1B includes a central mesh portion 32 and open weave lacing 34 interconnecting mesh portion 32 to side walls 38 of the head frame.

Most conventionally strung mesh pockets include one or more "throwing strings" or "shooting strings" extending transversely between the upper portions of sidewalls 108 and 110, proximate scoop 112 (see FIG. 1A). FIG. 1B shows transverse throwing strings 36 interwoven between the mesh diamonds. In addition to supporting the pocket stringing, the throwing strings prevent the thrown ball from traveling too far up the pocket assembly and striking the scoop, which can cause inaccurate passing and shooting. Thus, throwing strings are intended to be the point of departure of a thrown ball. Players use one or more throwing strings in a variety of locations and positions in the pocket to fine-tune and adjust their pocket to suit their style of play in catching, cradling, and throwing the ball.

Mesh pockets are typically entirely formed from either a "soft mesh" or a "hard mesh," each having its own advantages and disadvantages. Soft mesh pockets are more pliable and forgiving than hard mesh pockets, which enhances pocket formation and ball retention. Examples of materials from which soft mesh pockets are made include nylon, polyester, and combinations thereof. Soft mesh pockets require little, if any, break-in and readily form a deeper, less structured pocket from which a ball is more difficult to dislodge. This less structured pocket, however, can also can make it more difficult to shoot and pass. As the ball rolls from the stop member of the head toward the scoop, the soft mesh's tendency to sag hampers the release of the ball.

While interweaving shooting strings across the mesh can reduce this sagging effect, the soft mesh may still not support the heavy lacrosse ball, allowing the ball to get caught under (or being impeded rather than assisted by) the throwing strings. In addition, the throwing strings add another stringing member to the pocket, which adds weight to the lacrosse head and increases the time and effort needed to maintain the pocket. The traditional throwing string materials also tend to rot, break, crack, wear out, absorb water, and stretch due to weather conditions and the constant wear and tear of catching and throwing a lacrosse ball. In addition, the traditional throwing strings are difficult to adjust since they require the loosening of knots made to hold them in place and a tedious adjustment process along the portions of the throwing strings that are interwoven among the mesh diamonds.

In contrast to soft mesh pockets, hard mesh pockets are stiffer and firmer, typically made of a combination of materials such as nylon or polyester threads coated with a stiffening material such as urethane. The stiffening material hardens the threads and prevents the threads from absorbing moisture. The hard mesh addresses some of the throwing accuracy drawbacks of soft mesh pockets by providing a ball release surface that is firmer and more supportive. In addition, the stiffening material helps prevent possible moisture damage to the pocket, e.g., causing stretching or shrinking. Forming the pocket of hard mesh, however, makes it more difficult to catch and retain the ball in the pocket. A hard mesh pocket also requires a period of break-in to form the pocket. In addition, because the harder mesh retains its shape so well, ball dislodgement is easier.

SUMMARY OF THE INVENTION

The present invention provides a lacrosse stick mesh pocket that eliminates or minimizes many of the drawbacks of soft mesh pockets and hard mesh pockets, while providing many of the advantages of each. In particular, the present invention provides a soft mesh pocket that is selectively coated in strategic locations, to provide performance advantages traditionally associated with soft and hard mesh pockets, but without introducing the disadvantages of each. In this manner, the present invention provides a mesh lacrosse head pocket that has the throwing and shooting characteristics of hard mesh and the ball dislodgement characteristics of soft mesh.

In one embodiment, the present invention provides a soft mesh pocket having a portion of its strings coated to define a ball release area.

Another embodiment of the present invention provides a soft mesh pocket having a portion of its strings coated to define a ball pocket.

Another embodiment of the present invention provides a soft mesh pocket having a portion of its strings coated to define a throwing channel.

Additional embodiments of the present invention provide a soft mesh pocket having portions of its strings coated to define two or more of a ball release area, a ball pocket, and a throwing channel.

DETAILED DESCRIPTION OF THE INVENTION

Figure 1A:
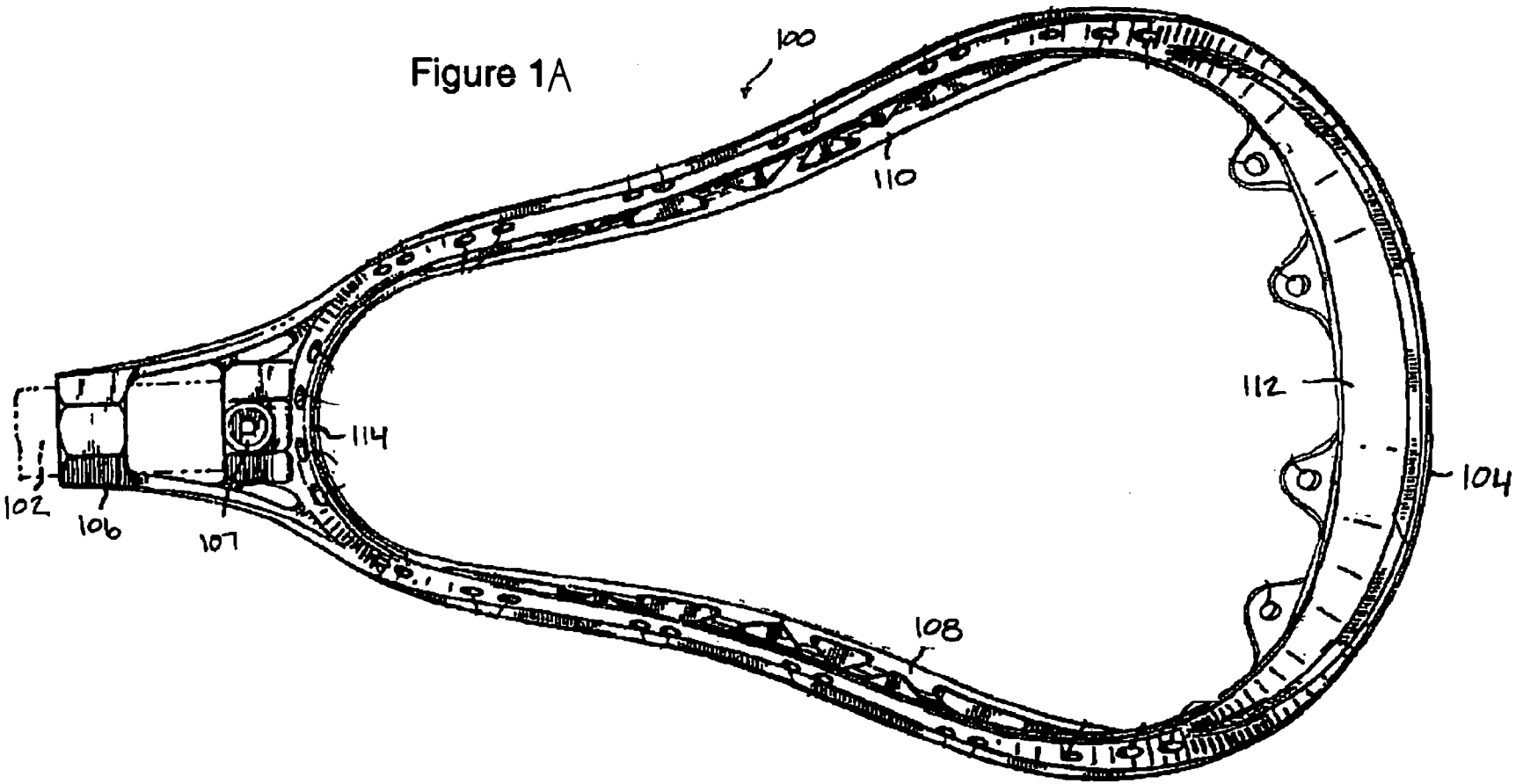
FIG. 1A is a schematic diagram of a conventional double-wall synthetic lacrosse head.
Figure 1B:
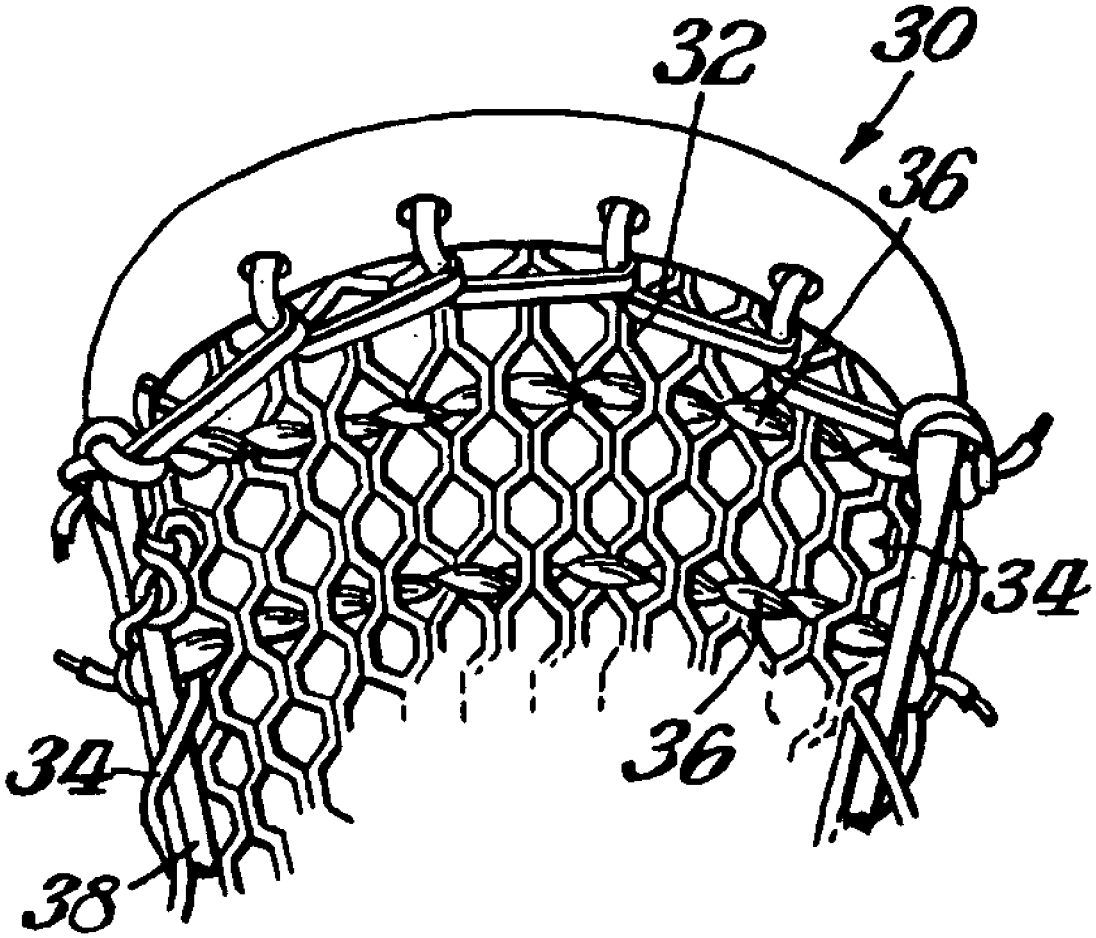
Fig. 1B. (Prior Art)
FIG. 1B is a schematic diagram of a portion of lacrosse stick head having a conventional mesh pocket with conventional throwing strings.
Figure 2:
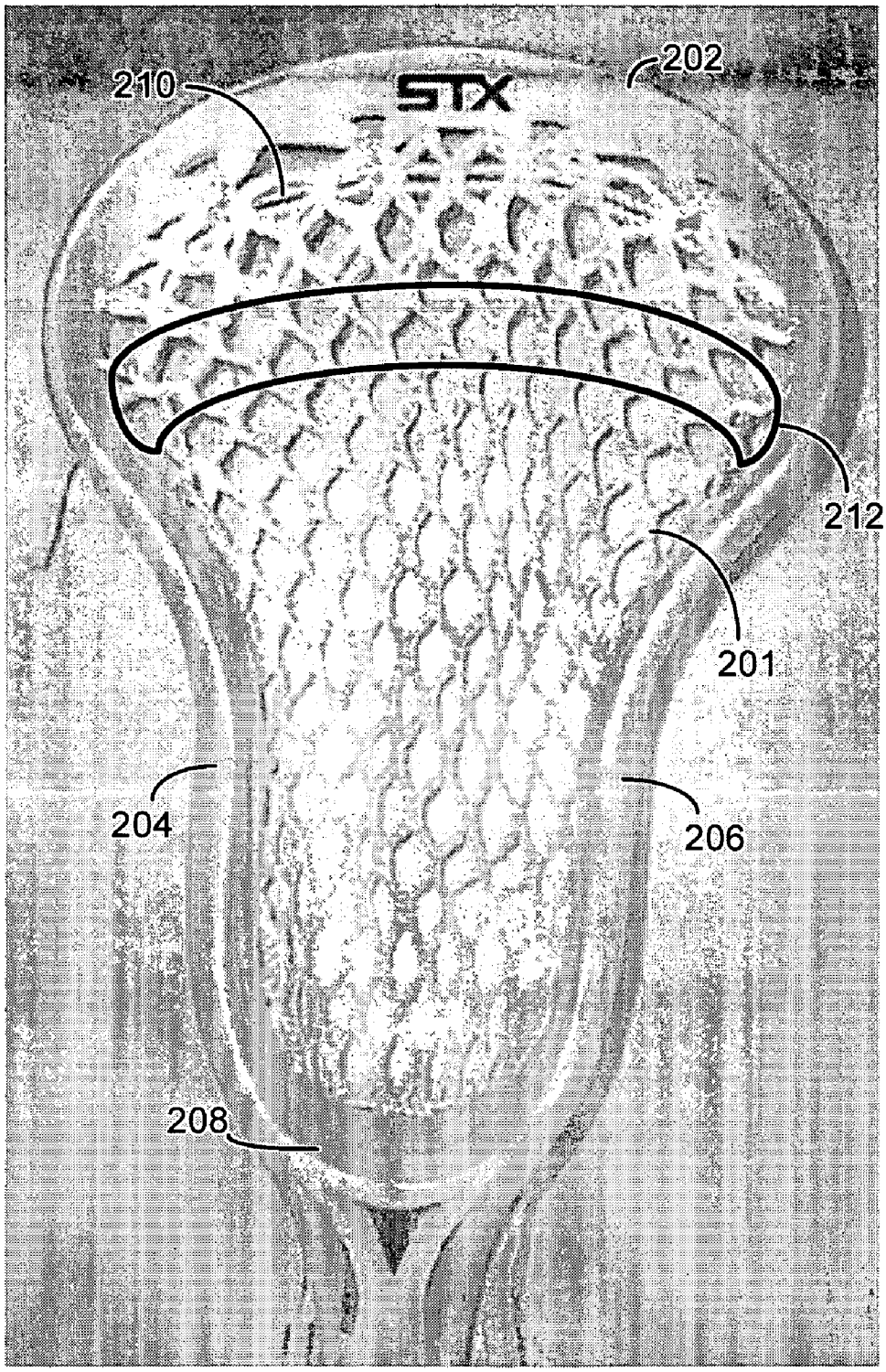
FIG. 2 is a schematic diagram of an exemplary soft mesh pocket having a portion of its strings coated to define a ball release area, according to an embodiment of the present invention.

FIG. 2 illustrates a lacrosse head 200 having a soft mesh pocket 201 with a portion of its strings coated to define a ball release area, according to an embodiment of the present invention. As shown, lacrosse head 200 includes a scoop 202, sidewalls 204 and 206 connected to scoop 202, and a stop member 208 connected to sidewalls 204 and 206. Together, scoop 202, sidewalls 204 and 206, and stop member 208 define the frame of lacrosse head 200. The frame defines an interior area in which the mesh pocket 201 is disposed. As shown, the mesh pocket is preferably disposed within the frame from proximate scoop 202 to proximate stop member 208 and from proximate sidewall 204 to proximate sidewall 206, thereby covering substantially the whole interior area of the frame.

In the example of FIG. 2, mesh pocket 201 is attached to head 200 using a lacing 210. Optionally, pocket 201 could attach directly to head 200 or through some other binding means (e.g., multiple stringing cords or hook and loop fasteners).

Mesh pocket 201 is made of a soft webbing, such as nylon, polyester, or combinations thereof, as is typical of soft mesh pockets of the prior art. However, portions of the soft webbing of mesh pocket 201 are coated with a stiffening material to change the characteristics of the mesh in those areas. In the example of FIG. 2, a coating is applied to a portion of mesh pocket 201 to provide a ball release area 212, as represented by the outlined area. This ball release area 212 is disposed transversely from sidewall 204 to sidewall 206 proximate to scoop 202, in an area in which throwing strings would typically be interwoven. The stiffer mesh of ball release area 212 eliminates the need for separate throwing strings and provides performance characteristics superior to throwing strings.

Examples of suitable stiffening materials with which to coat the soft webbing of pocket 201 include plastic coating materials such as Liquid Rope Whipping produced by West Marine of Watsonville, Calif., and Performix™ Plasti Dip™ produced by Plastic Dip International of Blaine, Minn. Other materials that can be used as the stiffening material include silicone, rubber, foam, urethane, and PPA coatings. Optionally, in a further embodiment of the present invention, the stiffening material could be a different color than the webbing of pocket 201 to indicate the areas of varying stiffness.

The stiffening material can be sprayed or painted on the soft webbing of pocket 201 or, alternatively, the soft webbing can be dipped. In one implementation involving a typically sized pocket 201, approximately 9 grams of stiffening material are evenly applied and allowed to harden for approximately four hours.

Applying a coating of stiffening material to the ball release area 212 provides a hardness at the upper part of the pocket that gives a player more feel for a ball in the pocket and a firm surface from which the ball releases out of the pocket. The enhanced feel enables more accurate and faster shots and passes, while maintaining enhanced ball handling ability and control through the remaining soft portion of mesh 201. The coating of stiffening material is also convenient to apply (e.g., by spraying, painting, or dipping), enabling a manufacturer to consistently form pockets and ball release areas of the same material, in the same thickness, and in the same location of the pocket.

In addition, with stiffening material applied in ball release area 212, a ball does not hook under area 212 as it would with traditional throwing strings. Ball release area 212 also keeps the ball from hooking under the bottom of the scoop. The stiffness of ball release area 212 provides the mesh with sufficient structure to prevent the ball from getting hung up in the upper portion of the head. In combination with soft mesh (i.e., uncoated areas), the coated ball release area 212 provides a smooth transition from the bottom of the pocket near stop member 208 to the top near scoop 202 when shooting and passing.

In eliminating the need for throwing strings, which close up some of the mesh "diamonds," the coated ball release area 212 exposes more open mesh in the direction of throwing and shooting, thereby improving the aerodynamics of the strung head. In addition, the weight of the head is reduced, e.g., eliminating the weight of three throwing strings weighing approximately 5 grams each. These improvements in aerodynamics and weight lead to better ball handling and throwing capabilities.

Although FIG. 2 illustrates a stiffening material applied to a single portion of a soft mesh pocket (i.e., ball release area 212), additional embodiments of the present invention apply stiffening material to other portions of the pocket to provide additional performance characteristics. One alternative embodiment applies the stiffening material to the portion of the pocket proximate to the stop member to form a desired pocket shape. Another alternative embodiment applies the stiffening material to the pocket in one or more strips from the stop member to the scoop, to create a throwing channel. Additional alternative embodiments apply stiffening material to the soft mesh pocket in multiple distinct portions, such as two or more of the ball release area, the ball pocket, and the throwing channel. These distinct portions of applied stiffening material may also each employ different materials with different stiffening properties to obtain variable results depending on each individual treatment.

Figure 3:
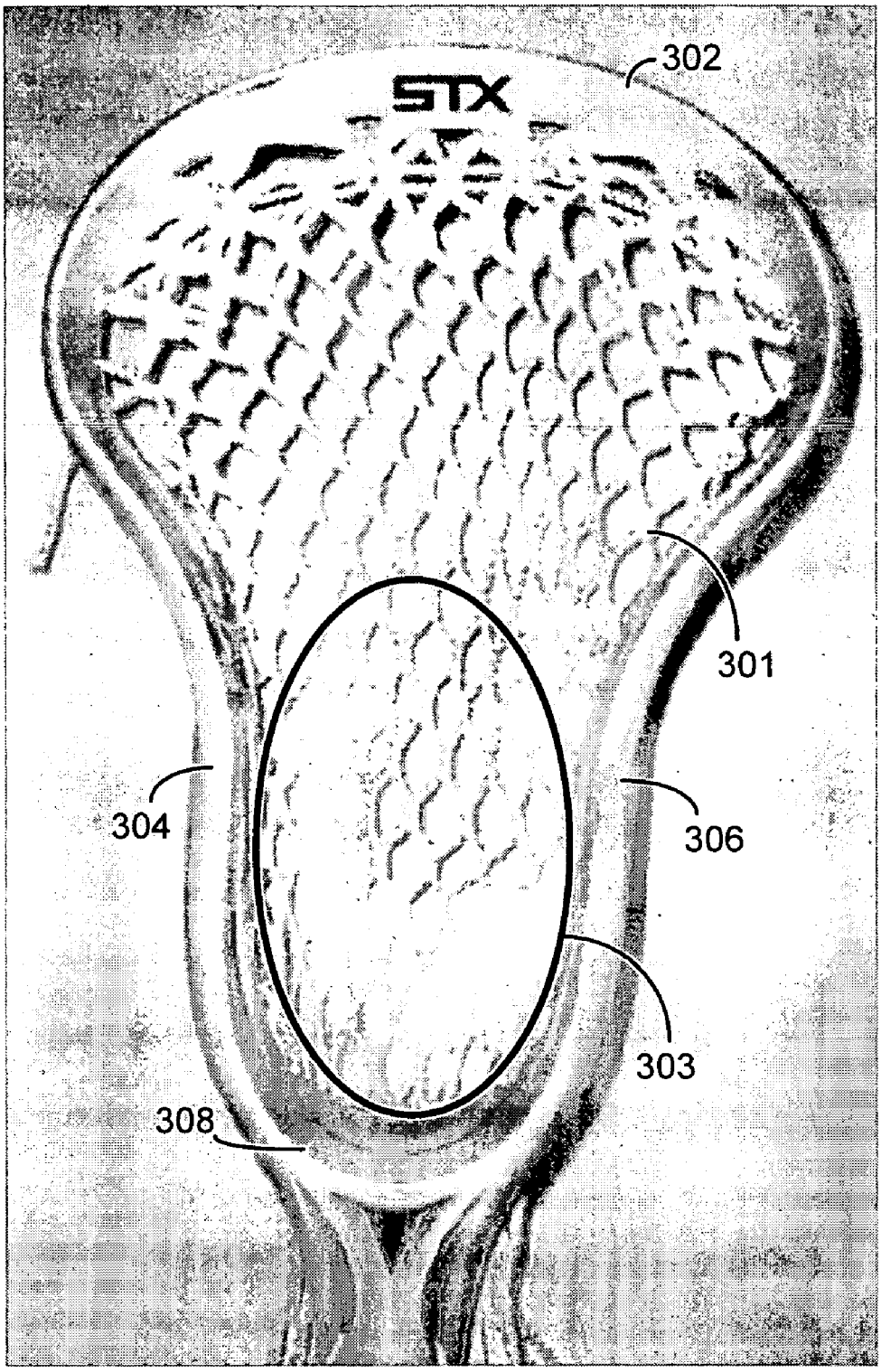
FIG. 3 is a schematic diagram of an exemplary soft mesh pocket having a portion of its strings coated to define a ball pocket, according to an embodiment of the present invention.

FIG. 3 illustrates a lacrosse head 300 having a soft mesh pocket 301 with a portion of its strings coated to define a ball pocket 303, according to an embodiment of the present invention. As shown, lacrosse head 300 includes a scoop 302, sidewalls 304 and 306 connected to scoop 302, and a stop member 308 connected to sidewalls 304 and 306. Together, scoop 302, sidewalls 304 and 306, and stop member 308 define the frame of lacrosse head 300 in which the mesh pocket 301 is disposed. Mesh pocket 301 is attached to head 300 using lacing or some other binding means.

As shown in FIG. 3, stiffening material is applied to soft mesh pocket 301 proximate stop member 308 in a generally oval shape to form ball pocket 303, as represented by the outlined area. This shape could, of course, vary depending on the desired pocket shape and performance. For example, the stiffening material of ball pocket 303 could be applied as a circular pattern or a donut pattern (i.e., having no stiffening material in the center of a circular or oval area). The area over which the stiffening material is applied may extend to the edge of the mesh pocket, as is shown in FIG. 3 at sidewalls 304 and 306, or may stop short of the edge to provide an area of stiffening material that is isolated in the mesh and fully surrounded by the area of uncoated mesh.

Applying stiffening material as shown in FIG. 3 provides a shaped pocket that requires little, if any, break in. In addition, because the stiffening material resists water absorption, protects the soft mesh pocket 301, and resists deformation, the ball pocket 303 retains its shape without requiring maintenance.

Figure 4:
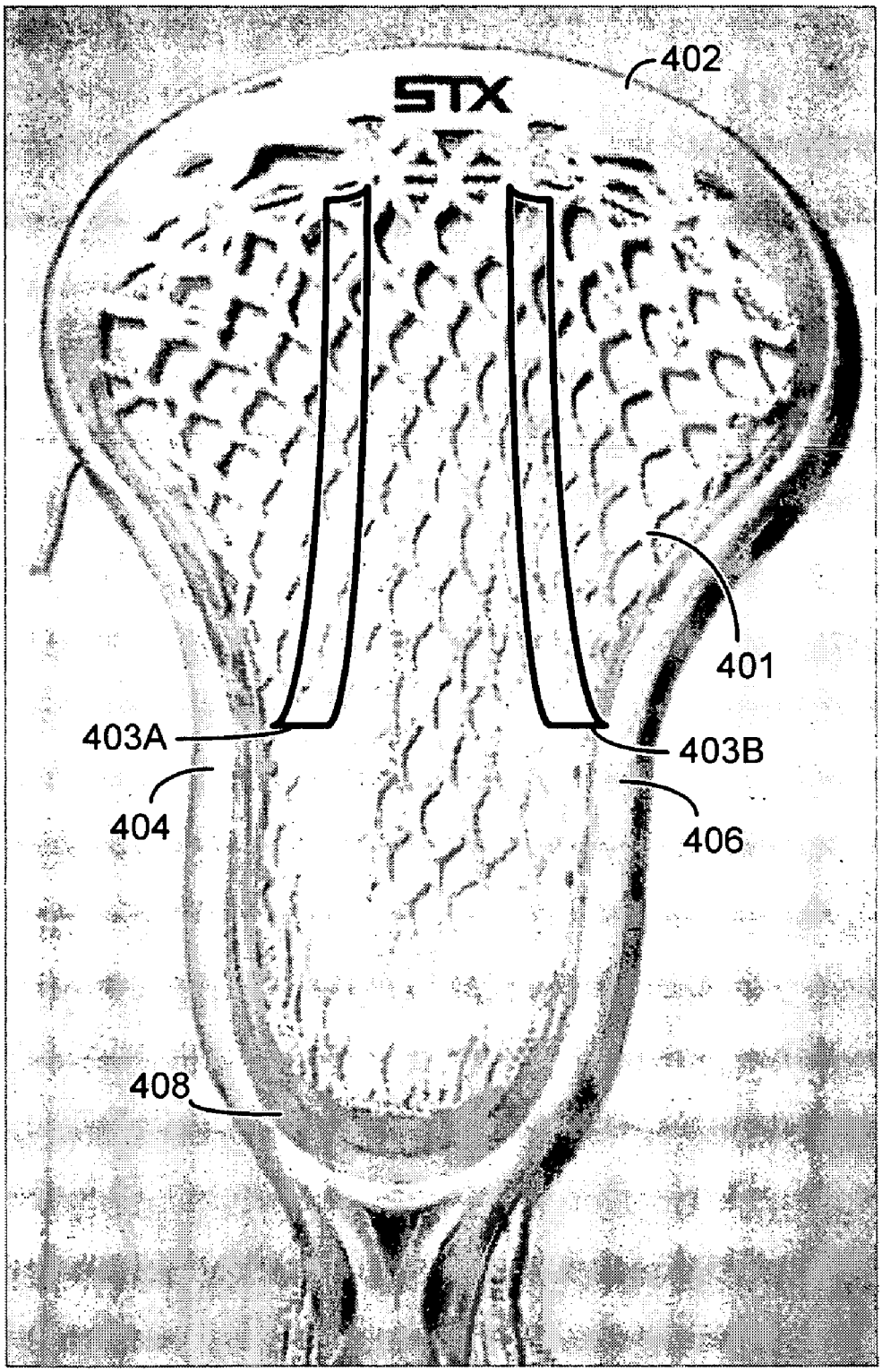
FIG. 4 is a schematic diagram of an exemplary soft mesh pocket having a portion of its strings coated to define a throwing channel, according to an embodiment of the present invention.

FIG. 4 illustrates a lacrosse head 400 having a soft mesh pocket 401 with a portion of its strings coated to define a throwing channel, according to an embodiment of the present invention. As shown, lacrosse head 400 includes a scoop 402, sidewalls 404 and 406 connected to scoop 402, and a stop member 408 connected to sidewalls 404 and 406. Together, scoop 402, sidewalls 404 and 406, and stop member 408 define the frame of lacrosse head 400 in which the mesh pocket 401 is disposed. Mesh pocket 401 is attached to head 400 using lacing or some other binding means.

As shown in FIG. 4, stiffening material is applied to soft mesh pocket 401 in two opposing linear strips 403A and 403B extending from sidewalls 404 and 406, respectively, to scoop 402. The shape and exact placement of throwing channel strips 403A and 403B on pocket 401 could, of course, vary depending on the desired pocket shape and performance. For example, instead of extending from sidewalls 404 and 406 to scoop 402, the stiffening material of throwing channel strips 403A and 403B could be applied from proximate the stop member 408 to the scoop 402. The width of the application areas of throwing channel strips 403A and 403B could also vary, as well the distance between the application areas in which the pocket 401 is uncoated. As an alternative embodiment, instead of two opposing linear strips, the throwing channel could be defined by a single width of stiffening material applied in a wide band from proximate stop member 408 to scoop 402.

Applying stiffening material as shown in FIG. 4 provides a throwing channel in soft mesh pocket 401. During a throwing motion, the throwing channel guides a ball up pocket 401, preferably keeping the ball aligned with the shaft axis of the lacrosse stick. This controlled release of the ball improves the accuracy of passing and shooting.

FIGS. 5-8 illustrates various combinations of the areas for applying stiffening material that are shown in FIGS. 2-4, according to additional embodiments of the present invention.

Figure 5:
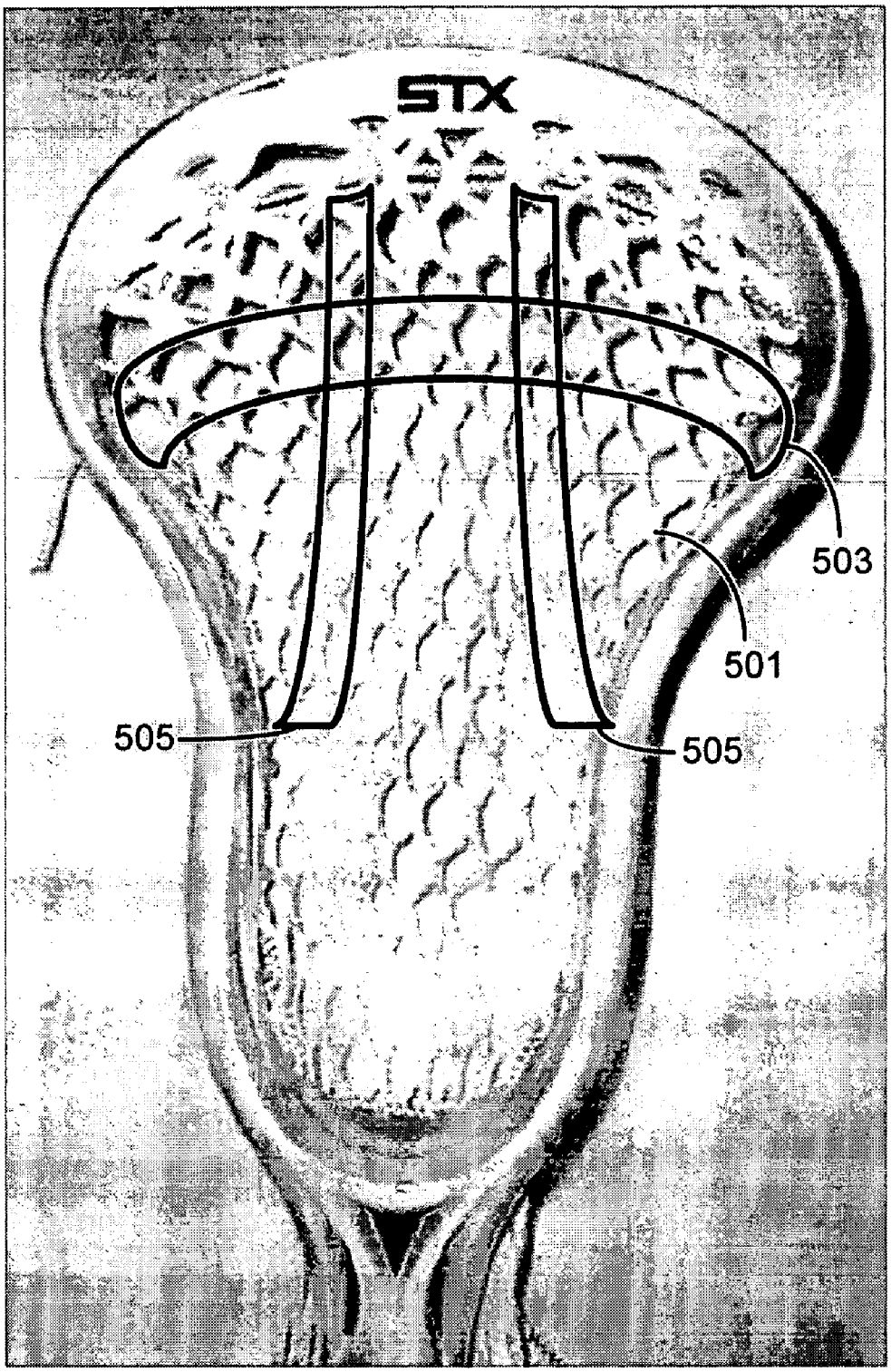
FIG. 5 is a schematic diagram of an exemplary soft mesh pocket having portions of its strings coated to define a ball release area and a throwing channel, according to an embodiment of the present invention.

FIG. 5 illustrates a lacrosse head 500 having a soft mesh pocket 501 with portions of its strings coated to define a ball release area 503 and throwing channel strips 505, according to an embodiment of the present invention.

Figure 6:
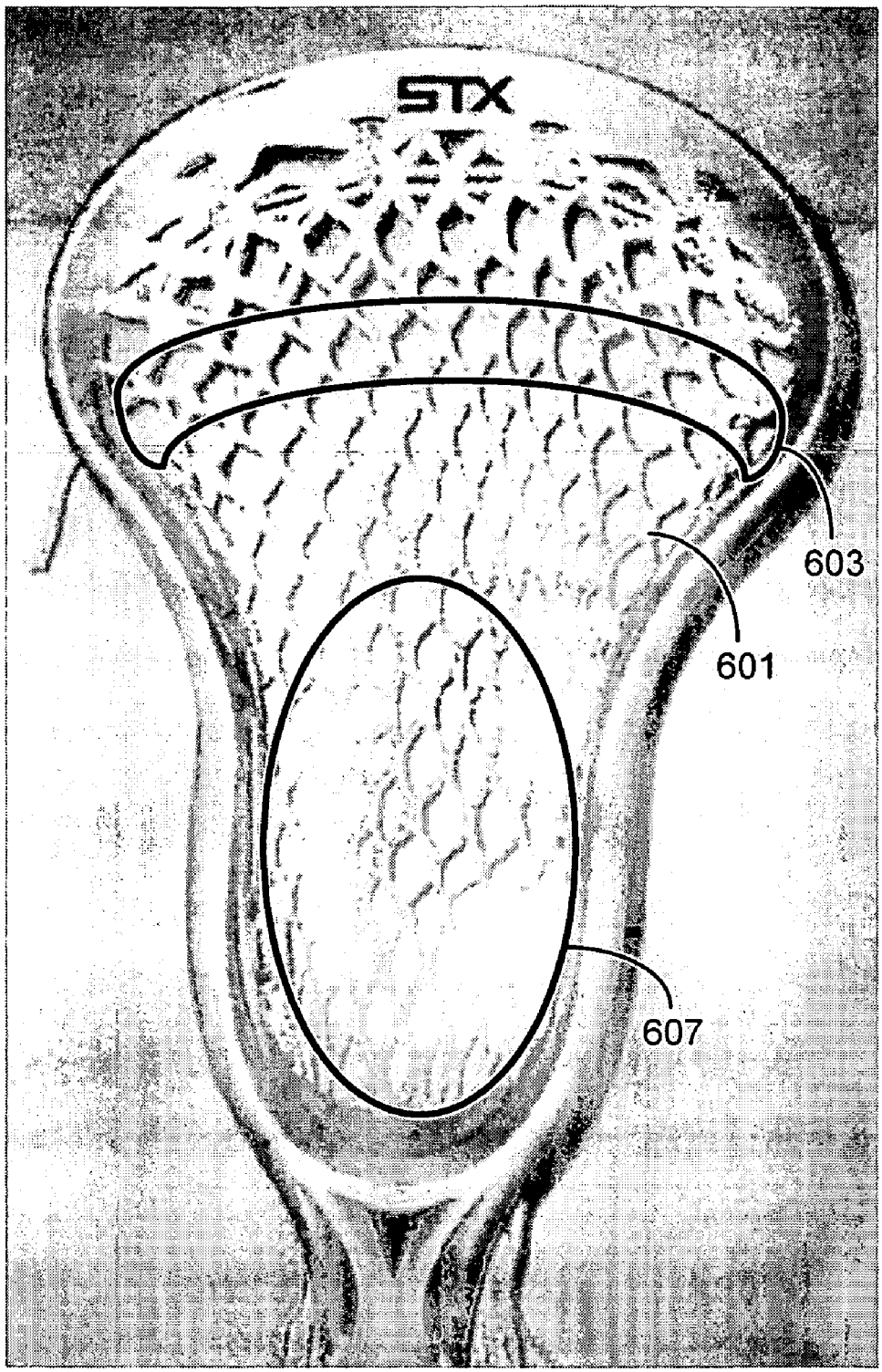
FIG. 6 is a schematic diagram of an exemplary soft mesh pocket having a portion of its strings coated to define a ball release area and ball pocket, according to an embodiment of the present invention.

FIG. 6 illustrates a lacrosse head 600 having a soft mesh pocket 601 with a portion of its strings coated to define a ball release area 603 and ball pocket 607, according to an embodiment of the present invention.

Figure 7:
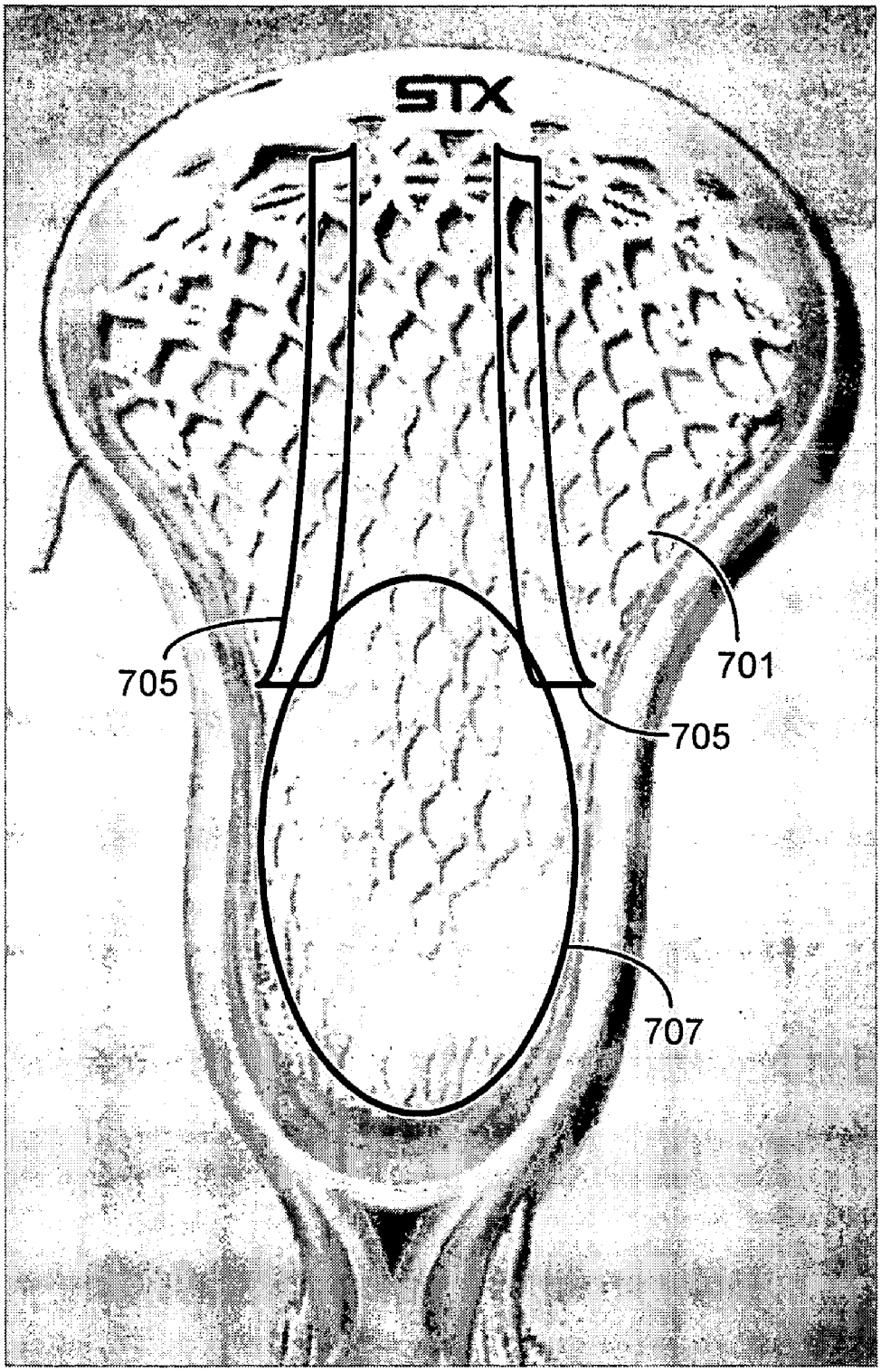
FIG. 7 is a schematic diagram of an exemplary soft mesh pocket having a portion of its strings coated to define a throwing channel and a ball pocket, according to an embodiment of the present invention.

FIG. 7 illustrates a lacrosse head 700 having a soft mesh pocket 701 with a portion of its strings coated to define throwing channel strips 705 and a ball pocket 707, according to an embodiment of the present invention.

Figure 8:
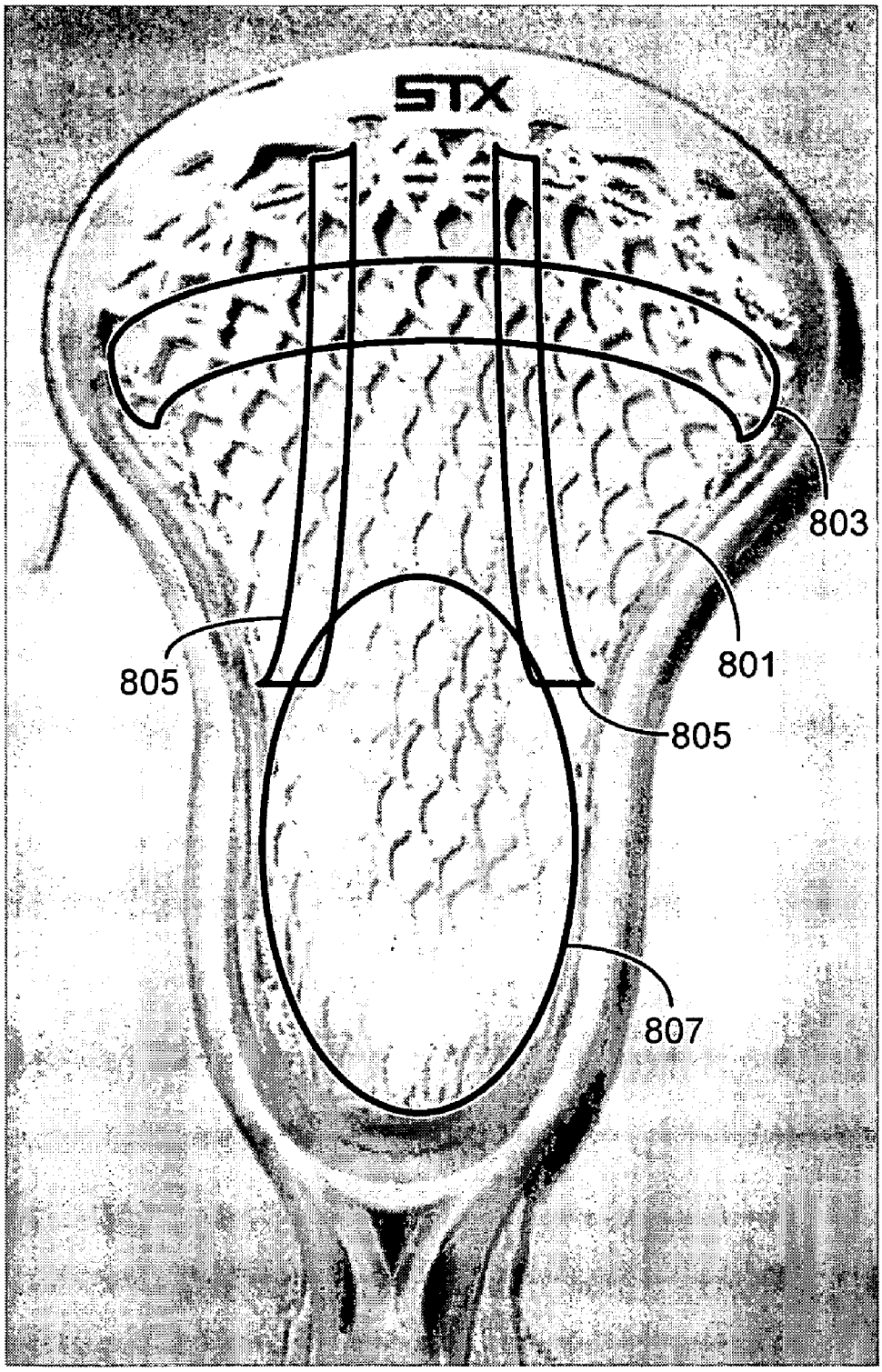
FIG. 8 is a schematic diagram of an exemplary soft mesh pocket having a portion of its strings coated to define a ball release area, a throwing channel, and a ball pocket, according to an embodiment of the present invention.

FIG. 8 illustrates a lacrosse head 800 having a soft mesh pocket 801 with a portion of its strings coated to define a ball release area 803, throwing channel strips 805, and a ball pocket 807, according to an embodiment of the present invention.

A further embodiment of the present invention provides a soft mesh pocket having a portion of its strings coated with varying thicknesses of stiffening material. The different thicknesses provide different degrees of stiffness, which can be used to alter and customize the performance characteristics of the pocket.

Figure 9:
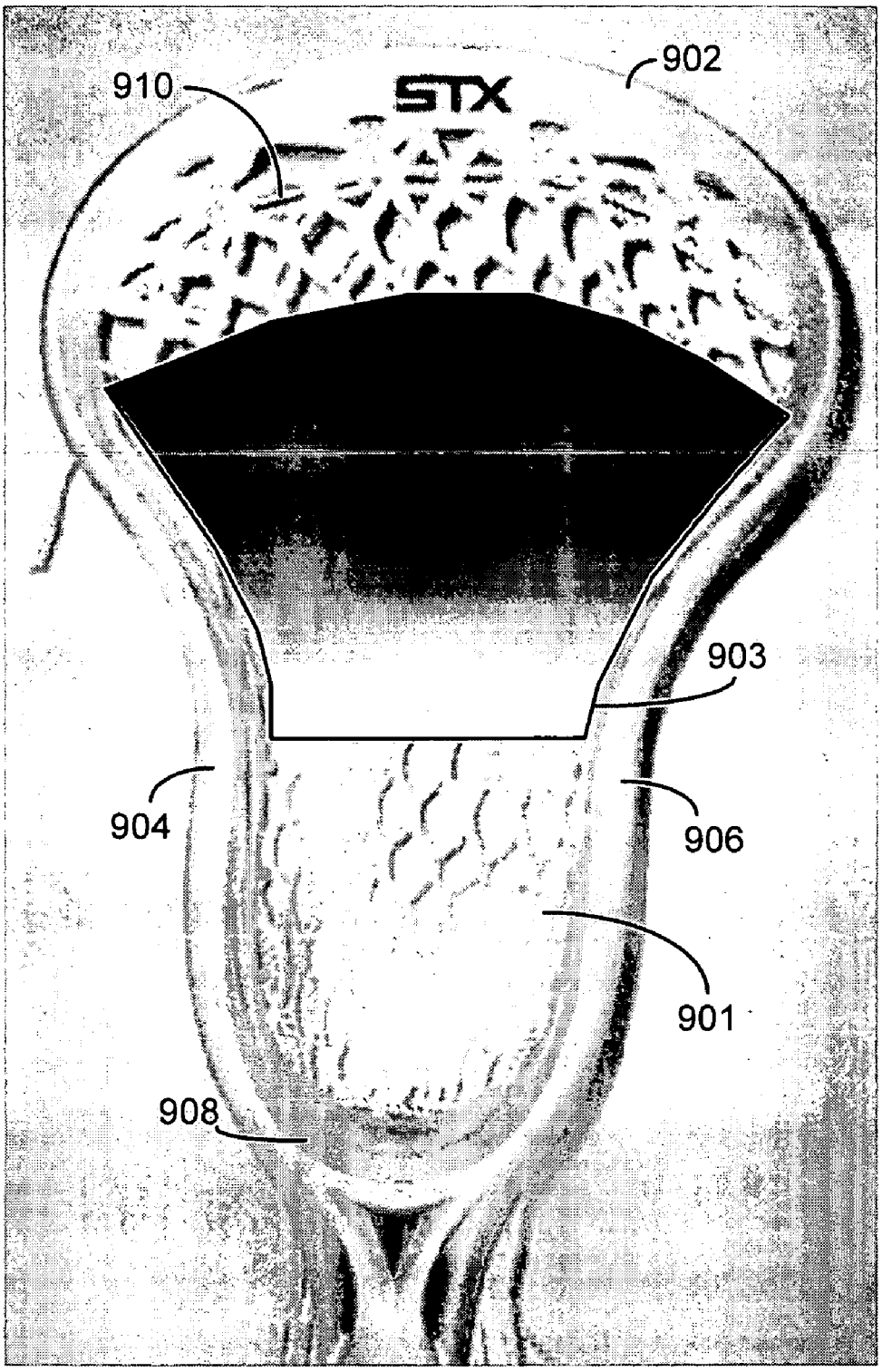
FIG. 9 is a schematic diagram of an exemplary soft mesh pocket having its strings coated at varying thickness to provide varying performance characteristics across the pocket, according to an embodiment of the present invention.

As one example, FIG. 9 illustrates a lacrosse head 900 having a soft mesh pocket 901 with a portion of its strings coated with an area 903 of varying thicknesses of stiffening material to provide a gradual transition of stiffness in the pocket 901. The varying thicknesses of stiffening material are represented graphically in the area 903 by the gradated shading, with the lightest shading indicating the thinnest coating and the darkest shading indicating the thickest.

As shown, lacrosse head 900 includes a scoop 902, sidewalls 904 and 906 connected to scoop 902, and a stop member 908 connected to sidewalls 904 and 906. Together, scoop 902, sidewalls 904 and 906, and stop member 908 define the frame of lacrosse head 900 in which the mesh pocket 901 is disposed. Mesh pocket 901 is attached to head 900 using lacing or some other binding means.

As shown in FIG. 9, stiffening material is applied to soft mesh pocket 901 in an area 903 extending from approximately halfway between stop member 908 and scoop 902 to proximate to scoop 902, where throwing strings are traditionally interwoven in a mesh pocket. The thickness of the stiffening material coating increases in area 903 in a direction from stop member 908 to the scoop 902. Optionally, in a further embodiment of the present invention, the changes in thickness are represented by changes in color, e.g., the color could darken as the thickness increases.

The shape of area 903 could, of course, vary depending on the desired pocket shape and performance. For example, area 903 could resemble the throwing channels strips 403A and 403B of FIG. 4, but with gradually thickening coatings from the stop member 908 to scoop 902.

Applying a gradated coating of stiffening material as shown in FIG. 9 enables an additional aspect of customization for a soft mesh pocket. By gradating the stiffening material from stiffest at the scoop area to a lesser stiffness towards the stop member, the present invention can prevent the effect of a whip that standard throwing strings and soft mesh can cause. A whip is generally understood in the art as the premature, uncontrolled downward release of the ball from the pocket, as the ball is precluded by either the frame geometry or the pocket from rolling toward the scoop and releasing controllably from the head. In addition, the gradated thickness keeps the ball from hooking under the coated mesh area, as can occur with throwing strings or the bottom of the scoop. The stiffening material provides the needed structure to the mesh to prevent the ball from getting hung up in the upper portion of the head. Moreover, the gradated coating enables a very smooth transition from the bottom of the pocket near the stop member to the top near the scoop, to provide a controlled consistent ball travel that improves the accuracy of shooting and passing.

As one of ordinary skill in the art would appreciate, in addition to varying the thickness of the coating of stiffening material, the composition of the stiffening material could also be varied to provide the desired gradation in stiffness.

In accordance with another alternative embodiment of the present invention, the coating applied to a soft mesh pocket provides a textured surface that grips a ball and provides desired ball control while catching, cradling, and throwing. This textured surface can be provided by, for example, the shape or composition of the stiffening material that is used to coat the strings. As an example of textured shapes, the coating of stiffening material can include nubs, protuberances, protrusions, projections, ridges, or knurling. The texture can be created by, for example, laying an uneven surface on the wet stiffening material and removing it before the stiffening material dries. As an example of textured compositions, grit (e.g., silica sand or silicon carbide) could be mixed with the stiffening material. In addition, texturized finishes and adhesive sprays, such as Tuf-Skin™ produced by Cramer Products Inc. of Gardner, Kans., can be applied to the dry stiffening material to increase friction.

Although the embodiments described and shown above illustrate coated mesh portions of particular sizes, shapes, and locations, one of ordinary skill in the art would appreciate that these sizes, shapes, and locations would vary between different implementations of the present invention, depending on such factors as the size of the lacrosse head, the shape of the lacrosse head, the type of lacrosse head (e.g., men's, women's, junior, or physical education/games), and the desired performance of the pocket. For example, in FIG. 2, the ball release area 212 running transversely from sidewall 204 to sidewall 206 could be narrower or wider (the width being measured in a direction from the stop member 208 to scoop 202) than it is shown in FIG. 2. Thus, the present invention should not be limited to the sizes, shapes, and locations of the coated portions shown in the drawings.

In addition, it should be understood that the areas of applied stiffening material shown in FIGS. 2-9 (e.g., area 212 of FIG. 3) are representative of a coating applied to the mesh. Although these areas are represented as continuous shapes in the figures, in the preferred embodiment, the stiffening material is applied as a coating on the individual stringing members of the mesh, thereby leaving open the diamond spaces of the mesh. Optionally, however, the diamond spaces could be covered by a film of the stiffening material spanning the coated stringing members.

Although the above embodiments illustrate the present invention in the context of modern synthetic double-wall lacrosse heads, one of ordinary skill in the art would appreciate that the present invention applies equally well to other types of lacrosse heads, such as wood lacrosse heads configured to accept mesh pockets. Indeed, the present invention could be applied to any lacrosse head capable of receiving a mesh pocket having coated strings.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. A lacrosse head comprising:

a stop member comprising a ball stop and a juncture;

a first sidewall connected to the stop member;

a second sidewall connected to the stop member opposite the first sidewall; and a scoop connected to the first sidewall and the second sidewall opposite the stop member, the stop member, the first sidewall, the second sidewall, and the scoop defining a frame surrounding an interior area; and a mesh pocket attached to the stop member, the first sidewall, the second sidewall, and the scoop of the frame, the mesh pocket having slack strings and substantially covering the interior area, a first area of the strings being coated with a stiffening material, the first area comprising only a portion of the interior area, and the remaining portion of the interior area comprising a second area of the strings that is uncoated, wherein the stiffening material has a variable thickness within the first area and wherein the first area is disposed transversely from the first sidewall to the second sidewall, the stiffening material increasing in thickness from a side of the first area nearest the stop member to a side of the first area nearest the scoop area.

2. The lacrosse head of claim 1, the first area being disposed transversely from the first sidewall to the second sidewall proximate to the scoop, and the second area comprising the remaining portion of the mesh pocket.

3. The lacrosse head of claim 1, the first area extending from proximate the scoop toward the stop member and defining a throwing channel, and the second area comprising the remaining portion of the mesh pocket.

4. The lacrosse head of claim 1, the stiffening material varying in composition such that the first area varies in stiffness.

5. The lacrosse head of claim 1, the strings made of one of nylon, polyester, and combinations thereof.

6. The lacrosse head of claim 1, the stiffening material comprising a plastic coating material.

7. The lacrosse head of claim 1, the stiffening material providing a textured surface.

8. The lacrosse head of claim 7, the textured surface comprising one of nubs, protuberances, protrusions, projections, ridges, and knurling.

9. The lacrosse head of claim 7, the stiffening material including grit.

10. The lacrosse head of claim 1, further comprising an adhesive spray applied to the stiffening material.

11. The lacrosse head of claim 1, the stiffening material having a first color, the strings having a second color, and the first color and the second color being different.

12. The lacrosse head of claim 1, the stiffening material varying in thickness within the first area, and the stiffening material having coloring indicating the varying thickness.

13. The lacrosse head of claim 1, the first area being surrounded by the second area.

14. The lacrosse head of claim 1, further comprising a handle attached to the head.

15. A pocket for a lacrosse head, the lacrosse head comprising a stop member having a ball stop and a juncture, a first sidewall connected to the stop member, a second sidewall connected to the stop member opposite the first sidewall, and a scoop connected to the first sidewall and the second sidewall opposite the stop member, wherein the stop member, the first sidewall, the second sidewall, and the scoop define an interior area, the pocket comprising:

a continuous piece of mesh, the mesh dimensioned to attach to the stop member, the first sidewall, the second sidewall, and the scoop, and to substantially cover the interior area; and a stiffening material coating a first area of the mesh, the first area comprising only a portion of the interior area, wherein the stiffening material has a variable thickness within the first area and wherein the first area is disposed transversely from the first sidewall to the second sidewall, the stiffening material increasing in thickness from a side of the first area nearest the stop member to a side of the first area nearest the scoop, and the remaining portion of the interior area comprising a second area of the mesh that is uncoated.

16. The pocket of claim 15, the mesh comprising woven strings having a plurality of openings, the stiffening material coating the strings within the first area, and the strings within the second area being uncoated.

17. The pocket of claim 16, the woven strings made of one of nylon, polyester, and combinations thereof.

18. The pocket of claim 15, the stiffening material coating comprising a plastic coating material.

19. The pocket of claim 15, the stiffening material coating providing a textured surface.

20. The pocket of claim 19, the textured surface comprising one of nubs, protuberances, protrusions, projections, ridges, and knurling.

21. The pocket of claim 19, the stiffening material including grit.

22. The pocket of claim 15, the first area being disposed transversely from the first sidewall to the second sidewall proximate to the scoop.

23. The pocket of claim 15, the first area extending from proximate the scoop toward the stop member and defining a throwing channel.

24. The pocket of claim 15, further comprising an adhesive spray applied to the stiffening material coating.

25. The pocket of claim 15, the stiffening material coating having a first color, the mesh having a second color, and the first color and the second color being different.

26. The pocket of claim 15, the stiffening material coating varying in thickness within the first area, and the stiffening material coating having coloring indicating the varying thickness.

27. The pocket of claim 15, the first area being surrounded by the second area.

28. The pocket of claim 15, the stiffening material covering the openings within the first area.

29. A lacrosse head comprising:

a stop member comprising a ball stop and a juncture;

a first sidewall connected to the stop member;

a second sidewall connected to the stop member opposite the first sidewall;

a scoop connected to the first sidewall and the second sidewall opposite the stop member, the stop member, the first sidewall, the second sidewall, and the scoop defining a frame surrounding an interior area; and a mesh pocket attached to the stop member, the first sidewall, the second sidewall, and the scoop of the frame, the mesh pocket having strings and substantially covering the interior area, a first area of the strings having a first stiffness, the first area comprising only a portion of the interior area, and the remaining portion of the interior area comprising a second area of the strings having a second stiffness, and the first stiffness being stiffer than the second stiffness, and the first stiffness varying across the first area and wherein the first area is disposed transversely from the first sidewall to the second sidewall, the first stiffness increasing from a side of the first area nearest the stop member to a side of the first area nearest the scoop.

30. The lacrosse head of claim 29, the first area being disposed transversely from the first sidewall to the second sidewall proximate to the scoop.

31. The lacrosse head of claim 29, the first area extending from proximate the scoop toward the stop member and defining a throwing channel.

32. The lacrosse head of claim 29, the first area of the strings being coated with a stiffening material, and the second area of the strings being uncoated.

33. The lacrosse head of claim 32, the stiffening material containing grit.

34. The lacrosse head of claim 32, the stiffening material providing a textured surface.

35. The lacrosse head of claim 32, further comprising an adhesive spray applied to the stiffening material.

36. The lacrosse head of claim 32, the stiffening material having a first color, the strings having a second color, and the first color and the second color being different.

37. The lacrosse head of claim 32, the stiffening material varying in thickness within the first area, and the stiffening material having coloring indicating the varying thickness.

38. The lacrosse head of claim 29, the first area being surrounded by the second area.

39. The lacrosse head of claim 29, further comprising a handle attached to the head.

* * * * *